US011209016B2

(12) United States Patent
Yang et al.

(10) Patent No.: US 11,209,016 B2
(45) Date of Patent: Dec. 28, 2021

(54) FAN FRAME

(71) Applicant: Delta Electronics, Inc., Taoyuan (TW)

(72) Inventors: Chao-Fu Yang, Taoyuan (TW); Pei-Han Chiu, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 27 days.

(21) Appl. No.: 16/733,457

(22) Filed: Jan. 3, 2020

(65) Prior Publication Data

US 2020/0224674 A1 Jul. 16, 2020

(30) Foreign Application Priority Data

Jan. 11, 2019 (CN) ..... 201910026333.4

(51) Int. Cl.

| | |
|---|---|
| ***F04D 25/08*** | (2006.01) |
| ***F04D 25/16*** | (2006.01) |
| ***F04D 29/40*** | (2006.01) |
| ***F04D 29/52*** | (2006.01) |
| ***F04D 29/64*** | (2006.01) |
| ***F04D 29/66*** | (2006.01) |

(52) U.S. Cl.

CPC ..... *F04D 29/522* (2013.01); *F04D 25/08* (2013.01); *F04D 25/166* (2013.01); *F04D 29/40* (2013.01); *F04D 29/646* (2013.01); *F04D 29/661* (2013.01); *F04D 29/665* (2013.01)

(58) Field of Classification Search

CPC ..... F04D 25/08; F04D 25/166; F04D 29/40; F04D 29/522; F04D 29/646; F04D 29/661; F04D 29/665

See application file for complete search history.

(56) References Cited

U.S. PATENT DOCUMENTS 5,649,587 A * 7/1997 Plant ..... F01P 5/06 123/41.49
5,997,266 A * 12/1999 Lecinski ..... F04D 25/16 361/695
6,071,082 A * 6/2000 Lecinski ..... F04D 25/166 361/695
6,491,502 B2 * 12/2002 Hunt ..... F04D 29/681 417/360

(Continued)

FOREIGN PATENT DOCUMENTS

CN 1975177 A 6/2007
CN 102588348 A 7/2012

OTHER PUBLICATIONS

Office Action of corresponding CN Application No. 201910026333.4, dated Nov. 2, 2020, 9 pages.

*Primary Examiner* — Audrey B. Walter
(74) *Attorney, Agent, or Firm* — Muncy, Geissler, Olds and Lowe, P.C.

(57) ABSTRACT

A fan frame is provided and includes a body and a first cover plate. The body includes a main surface and a first side which is substantially perpendicular to the main surface. A first channel and a second channel, which are adjacent to each other, are formed in the body, and a first space is formed among the main surface, the first side, a sidewall of the first channel, and a sidewall of the second channel. The cover plate is disposed on the body, and covers the first space, wherein a first hole is formed in the first cover plate, and the first space communicates with the external environment via the first hole.

9 Claims, 5 Drawing Sheets

(56) References Cited

U.S. PATENT DOCUMENTS

| | | | | |
|---|---|---|---|---|
| 2001/0018022 | A1* | 8/2001 | Nakamura | F04D 29/545<br>415/203 |
| 2007/0264122 | A1* | 11/2007 | Iwasaki | F04D 19/007<br>416/120 |
| 2012/0045325 | A1* | 2/2012 | Horng | F04D 25/0606<br>415/220 |
| 2018/0142708 | A1* | 5/2018 | Horng | F04D 29/522 |

* cited by examiner

10

10

FAN FRAME

CROSS REFERENCE TO RELATED APPLICATIONS

This application claims priority of China Patent Application No. 201910026333.4, filed Jan. 11, 2019, the entirety of which is incorporated by reference herein.

BACKGROUND

Technical Field

The disclosure relates to a fan frame, and in particular to a fan frame that includes a hollow silencing structure in the body.

Description of the Related Art

As technology continues to develop, the performance of electronic apparatuses is becoming better and better. However, when processing massive amounts of data, a large amount of heat may be generated. If the heat is not removed in time, the electronic apparatus may be damaged to such a degree that it becomes incapable of performing its original purpose. Generally speaking, one or more fans are currently disposed in an electronic apparatus, to remove the heat inside the electronic apparatus via convection. However, the operation of the fan may generate noise at a certain volume, causing users discomfort. Therefore, how to eliminate a particular frequency of noise generated during the operation of a fan is an important issue in the field of the present disclosure.

BRIEF SUMMARY

For solving the aforementioned problems, some embodiments of the present disclosure provide a fan frame. The fan frame includes a body and a cover plate. The body includes a main surface and one side, which is substantially perpendicular to the main surface. A first channel and a second channel, which are adjacent to each other, are formed in the body, and a space is formed among the main surface, the side, a sidewall of the first channel, and a sidewall of the second channel. The cover plate is disposed on the body, and covers the space, wherein a hole is formed in the cover plate, and the space communicates with the external environment via the hole. The cover plate may also partially cover the space, such that the space communicates with the external environment.

In an embodiment, the body further includes an upper portion and a lower portion, the upper portion and the lower portion each has a connecting structure, and the upper portion and the lower portion are integrated by the connecting structures. The cover plate is removably disposed on the upper portion or the lower portion. The upper portion and the lower portion have a positioning structure located on the sidewall of the first channel and/or the sidewall of the second channel. In an embodiment, the fan frame further includes a first base, a second base, and a plurality of ribs. The first base is disposed in the first channel. The second base is disposed in the second channel. The ribs are disposed around the first base and the second base, wherein the first base and the second base are connected to the body via the ribs. In an embodiment, each of the ribs has a jagged structure disposed on one side of the ribs. The first channel and the second channel penetrate the body.

In an embodiment, the body further has another side that is parallel to the side of the body, and another space is formed among the main surface, the other side, the sidewall of the first channel, and the sidewall of the second channel. In an embodiment, the fan frame further includes another cover plate disposed on the body and covering the other space, wherein another hole is formed on the other cover plate, and the other space communicates with the external environment via the other hole. The volume of the other space is substantially equal to the volume of the space.

BRIEF DESCRIPTION OF THE DRAWINGS

The disclosure can be more fully understood by reading the subsequent detailed description and examples with references made to the accompanying drawings, wherein.

DETAILED DESCRIPTION OF THE INVENTION

The fan frames of some embodiments of the present disclosure are described in the following description. However, it should be appreciated that the following detailed description of some embodiments of the disclosure provides various concepts of the present disclosure which may be performed in specific backgrounds that can vary widely. The specific embodiments disclosed are provided merely to clearly describe the usage of the present disclosure by some specific methods without limiting the scope of the present disclosure.

Unless defined otherwise, all terms (including technical and scientific terms) used herein have the same meaning as commonly understood by one of ordinary skill in the art to which this disclosure belongs. It should be appreciated that, in each case, the term, which is defined in a commonly used dictionary, should be interpreted as having a meaning that conforms to the relative skills of the present disclosure and the background or the context of the present disclosure, and should not be interpreted in an idealized or overly formal manner unless so defined in the present disclosure.

Figure 1:
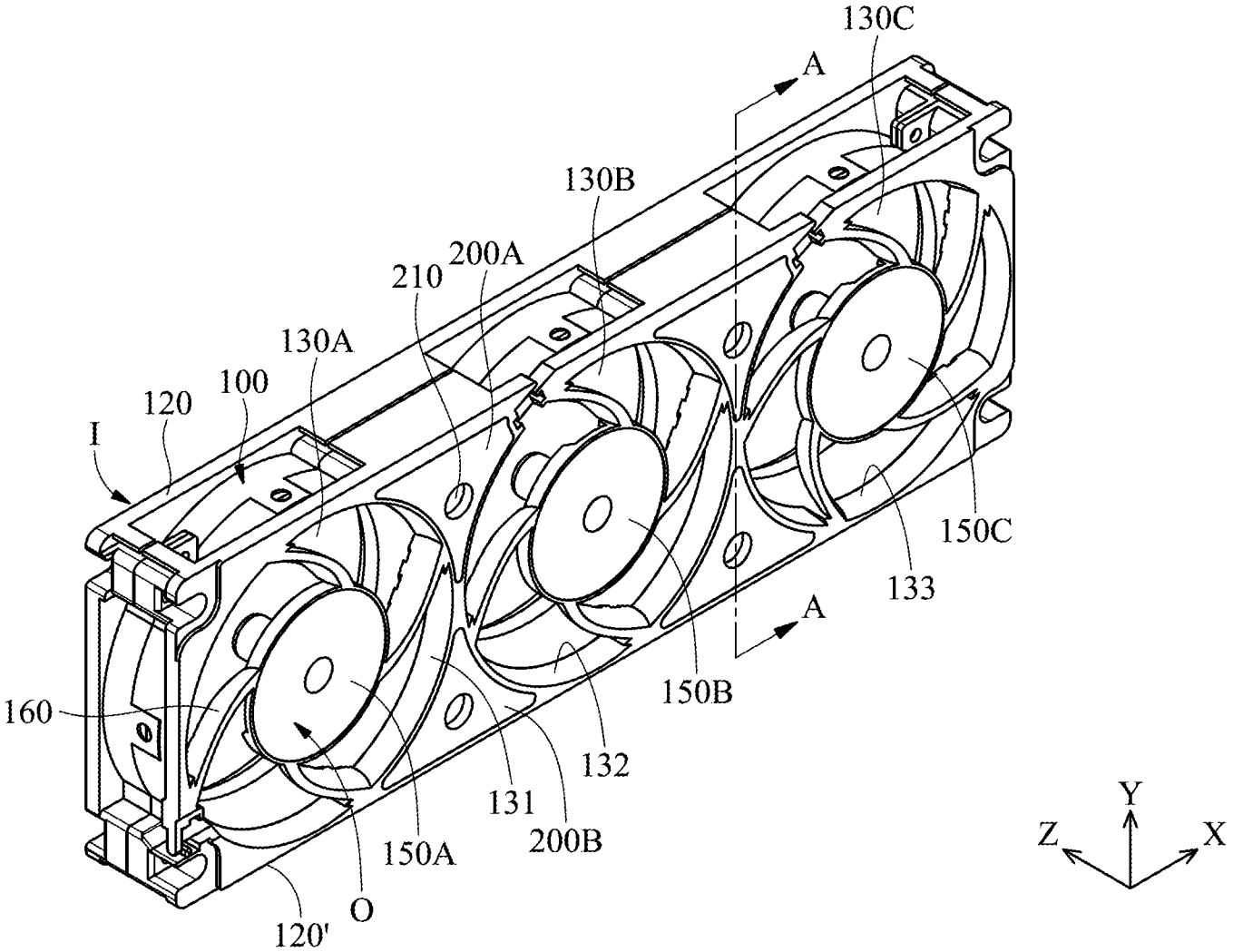
FIG. 1 is a perspective view illustrating a fan frame in accordance with an embodiment of the present disclosure.
Figure 4:
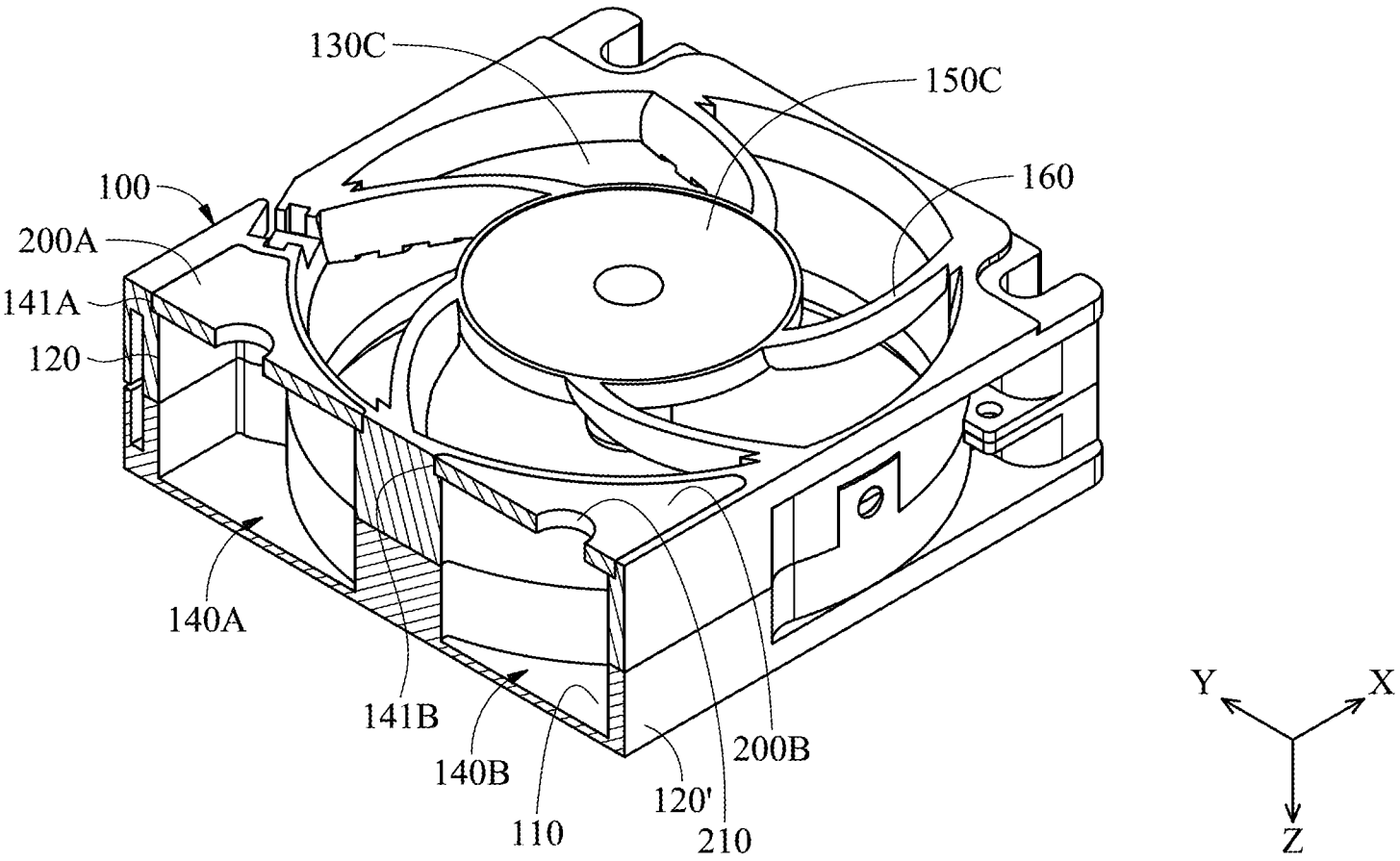
FIG. 4 is a cross-sectional view illustrating along line A-A shown in FIG. 1.

Referring to FIG. 1, FIG. 1 is a perspective view illustrating a fan frame 10 in accordance with an embodiment of the present disclosure. It should be appreciated that the fan frame 10 may serve as a housing of a fan device, and may be disposed in any suitable electronic device. The fan device may be configured to remove heat inside the electronic device. As shown in FIGS. 1 and 4, the fan frame 10 includes a body 100 and at least one cover plate 200A and/or 200B (referred to as the cover plates 200A, 200B thereinafter). The body 100 includes a main surface 110 (shown in FIG. 4) and two sides 120, 120', wherein the main surface 110 is a reference plane that is perpendicular to a ventilation direction (namely, perpendicular to Z-axis in FIG. 1). In other words, the main surface 110 is substantially parallel to an X-Y plane in FIG. 1, and the sides 120, 120' is substantially perpendicular to the reference plane (Z-X plane). That is, the sides 120, 120' are substantially parallel to each other.

In the present embodiment, a first channel 130A, a second channel 130B, and a third channel 130C are formed in the body 100, wherein the first channel 130A is adjacent to the second channel 130B, and the second channel 130B is adjacent to the third channel 130C. In other words, the second channel 130B is located between the first channel 130A and the third channel 130C. The first channel 130A, the second channel 130B, and the third channel 130C are located between the two sides 120, 120' of the body 100. Thanks to the arrangement of the first channel 130A, the second channel 130B, and the third channel 130C, air may pass through the fan frame 10 along the vertical direction (the Z-axis), and the main surface 110 is perpendicular to the direction of the airflow. According to the direction in which the air flows through the first channel 130A, the second channel 130B, and the third channel 130C, an inlet side I and an outlet side O of the body 100 may be defined. The inlet side I and the outlet side O are both parallel to the X-Y plane. When observed from the angle of view shown in FIG. 1, the outlet side O is the side closest to the observer, the inlet side I is on the other side, the side that is away from the observer. Although three channels, which are arranged linearly, are illustrated in the present embodiment, and merely serve as an example, but they are not intended to limit the present disclosure. Those skilled in the art may adjust the number and arrangement of the channels of the fan frame 10 as required.

Figure 3:
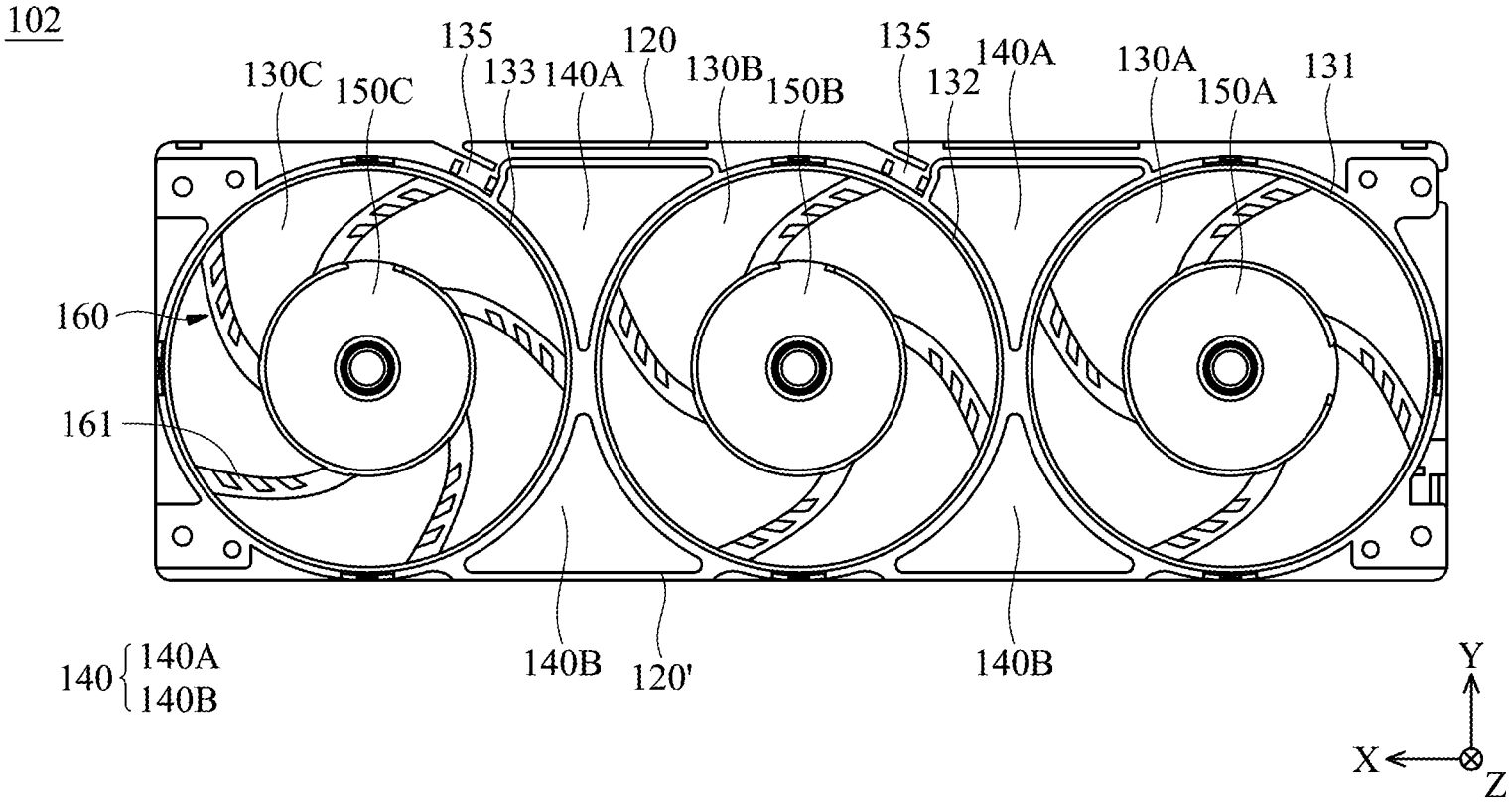
FIG. 3 is a top view illustrating the lower portion shown in FIG. 2.

In addition, a space 140 (including spaces 140A, 140B, which are shown in FIGS. 3 and 4) is formed among the main surface 110, the side 120, a sidewall 131 of the first channel 130A, and a sidewall 132 of the second channel 130B. The space 140 has openings for arranging cover plates 200A and 200B. The cover plates 200A and 200B are disposed on the body 100 (namely, disposed in the openings of the space 140) to form a hollow chamber. A hole 210 is respectively formed in the cover plates 200A and 200B, and the space 140 (that is, the hollow chamber) communicates with external environment via the holes 210. It should be noted that the holes 210 are generally located on the outlet side O to achieve the effect of reducing noise in a particular frequency.

It should be appreciated that the aforementioned arrangement merely serves as an exemplary example, but not intends to limit the present disclosure. A space 140 is generally disposed among one of the sides of the body and sidewalls of two different channels. For example, in some embodiments, the space 140 may be formed among the main surface 110, the side 120', the sidewall 131 of the first channel 130A, and the sidewall 132 of the second channel 130B. In some embodiments, the space 140 may be formed among the main surface 110, the side 120 (or the side 120'), the sidewall 132 of the second channel 130B, and a sidewall 133 of the third channel 130C. Those skilled in the art may adjust the position of the space 140 according to the frequency of the noise to be reduced. In some embodiments, the body 100 of the fan frame 10 may be made of plastic or metallic material. The cover plates 200A and 200B may also extend towards the sidewall 131 or 132 without departing from the inventive concept of the present disclosure.

Thanks to the arrangement of the space 140 and the cover plates 200A, 200B located on the body 100, hollow chambers may be formed in the body 100 of the fan frame 10. As a result, noise in a particular frequency (such as the narrow frequency of fan blades) generated during the operation of the fan device may be significantly reduced. In addition, the size of the space 140 may also be adjusted to reduce noise in a particular frequency. In some other embodiments, the cover plates 200A and 200B may be disposed in the space 140 in order to adjust the size of the space 140, wherein the size of the cover plates 200A and 200B is the same as the size of the space 140. Therefore, the effect of reducing noises at different frequencies may be achieved. Although the holes 210 of the cover plates 200A and 200B are illustrated as circular shapes and located at the centers of the cover plates 200A and 200B in the present embodiment, those skilled in the art may adjust the shape and position of the holes 210 in the cover plates 200A and 200B to reduce noise in a particular frequency as required. That way, the effect of reducing noises at different frequencies may also be achieved. In some embodiments, the cover plates 200A and 200B may be made of the same material as the body 100 of the fan frame 10.

A first base 150A is disposed in the first channel 130A, a second base 150B is disposed in the second channel 130B, and a third base 150C is disposed in the third channel 130C. The first base 150A, the second base 150B, and the third base 150C are respectively configured to support motor structures (not shown) disposed on the first base 150A, the second base 150B, and the third base 150C. The motor structures may be combined with a fan impeller and rotate in the first channel 130A, the second channel 130B, and the third channel 130C, respectively, for driving airflow in order to dissipate the heat inside the electronic device. For example, the first base 150A, the second base 150B, and the third base 150C are disposed on the outlet side of the fan device. However, the first base 150A, the second base 150B, and the third base 150C may be disposed on the inlet side of the fan device as required. In addition, a plurality of ribs 160 are disposed around the first base 150A, the second base 150B, and the third base 150C, and the first base 150A, the second base 150B, and the third base 150C are connected to the body 100 via the ribs 160.

Figure 2:
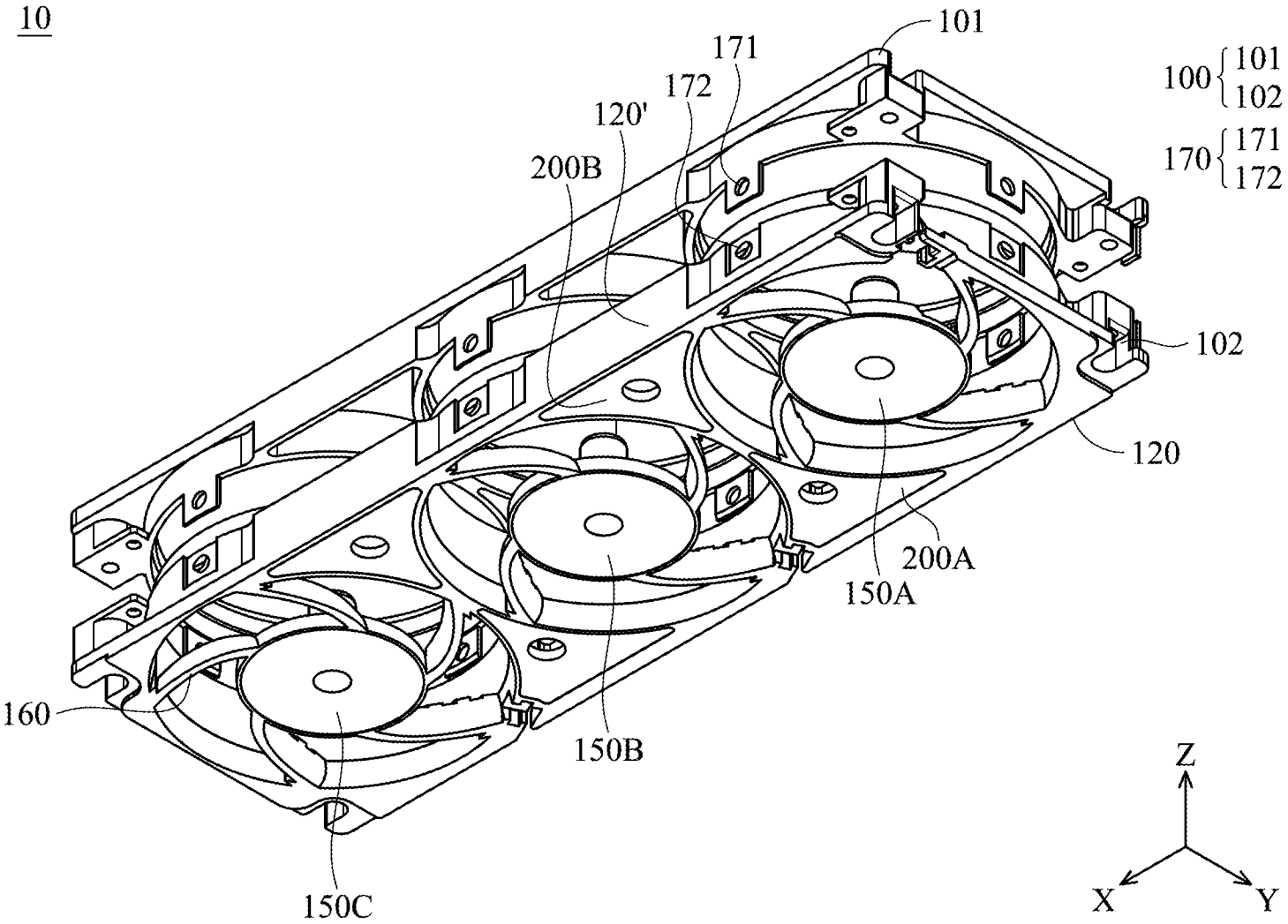
FIG. 2 is a perspective view illustrating an upper portion and a lower portion of a body in accordance with an embodiment of the present disclosure.

Referring to FIG. 2, FIG. 2 is a perspective view illustrating an upper portion 101 and a lower portion 102 of the body 100 in accordance with an embodiment of the present disclosure. As shown in FIG. 2, the body 100 may be divided into the upper portion 101 and the lower portion 102. The upper portion 101 has a first connecting structure 171, and the lower portion 102 has a second connecting portion 172. In the present embodiment, the first connecting structure 171 is a concave hole, and the second connecting portion 172 is a protrusion corresponding to the first connecting structure 171. The first connecting structure 171 and the second connecting structure 172 may constitute a connecting assembly 170. The upper portion 101 and the lower portion 102 may be integrated via the connecting assembly 170. In other embodiments, the connecting assembly 170 may also be a mortise and tenon joint, a screw, or any other structure that may combine the upper portion 101 and the lower portion 102.

Generally, the body 100 may be formed by molding. In the present embodiment, a hollow portion is disposed in the body 100. If the body 100 is integrally formed by molding, a barb structure may be formed when the core and the cavity combine. Therefore, the difficulty of molding is significantly increased, causing the yield and productivity of manufacturing the body 100 to decrease. Therefore, in the present embodiment, the body 100 is divided into two pieces, which are respectively formed using different molding. Accordingly, barbed structures are prevented from forming when the moldings are combined, such that the difficulty of molding is decreased, increasing the productivity of the body 100.

It should be noted that the openings (namely, positions for arranging the cover plates 200A and 200B) of the space 140 are located on the lower portion 102 in the present embodiment, but the openings of the space 140 may also be located on the upper portion 101 as required, or the openings of the space 140 may also be located on the upper portion 101 and the lower portion 102 (that is, the space 140 penetrates the body 100.) In other words, the cover plates 200A and 200B are disposed on the upper portion 101, on the lower portion 102, or on both of the former two. As the openings of the space 140 are disposed on the upper portion 101 and the lower portion 102 at the same time, the cover plates 200A and 200B with or without the hole 210 may be selectively disposed on the upper portion 101 and the lower portion 102. That way, the arrangement and positions (that is, the holes 210 are located on the upper portion 101 or on the lower portion 102) of the holes 210 may be adjusted easily even after the formation of the body 100 is completed. The cover plates 200A and 200B are not limited to the appearance shown in FIG. 1, and may also partially cover the spaces 140A and 140B as long as the spaces remain communicating with external environment. Therefore, the holes 210 are not necessary to be disposed in the cover plates 200A and 200B.

Next, referring to FIG. 3, FIG. 3 is a top view illustrating the lower portion 102 shown in FIG. 2. As shown in FIG. 3, the space 140 includes spaces 140A and 140B, wherein the space 140A is disposed among the sidewall 131 of the first channel 130A, the sidewall 132 of the second channel 130B, and the side 120, and the space 140B is disposed among the sidewall 131 of the first channel 130A, the sidewall 132 of the second channel 130B, and the side 120'. The difference between the spaces 140A and 140B is that the space 140B is a symmetric shape, wherein Y-axis serves as the symmetric axis. However, in order to reserve a space for arranging a cable, an arranging structure 135 is disposed. Electrical signals are transmitted to a motor structure (not shown) of the fan device via the cable, such that parameters regarding whether the motor structure rotates or its rotation rate are controlled. Therefore, the space 140A is not symmetric. Although the shapes of the spaces 140A and 140B are not exactly the same, partial thickness of the sidewall 131 of the first channel 130A and/or the sidewall 132 of the second channel 130B may be adjusted, making the volumes of the spaces 140A and 140B substantially the same. For example, the thickness, close to the space 140A, of the sidewall 131 of the first channel 130A and/or the sidewall 132 of the second channel 130B may be reduced, or the thickness, close to the space 140B, of the sidewall 131 of the first channel 130A and/or the sidewall 132 of the second channel 130B may be increased. In other embodiments, the volume of the space 140A may not be equal to the volume of the space 140B according to design demands. In addition, a jagged structure 161 may be disposed on one side (namely, the inner side of the fan device), which faces the upper portion 101 (shown in FIG. 5), of the ribs 160 for reducing noise in a particular frequency.

Referring to FIG. 4, FIG. 4 is a cross-sectional view illustrating along line A-A shown in FIG. 1. As shown in FIG. 4, the cover plates 200A and 200B are disposed on the body 100, making the spaces 140A and 140B hollow chambers. It should be noted that steps 141A, 141B are formed around the openings of the spaces 140A, 140B. Therefore, when the cover plates 200A and 200B are disposed on the body 100, the cover plates 200A and 200B may be positioned at the steps 141A, 141B, instead of falling into the spaces 140A, 140B. As a result, the cover plates 200A, 200B and the third base 150C (or the first base 150A and the second base 150B) may be disposed on the same horizontal plane (X-Y plane), so that the fan device may have a flat appearance.

Figure 5:
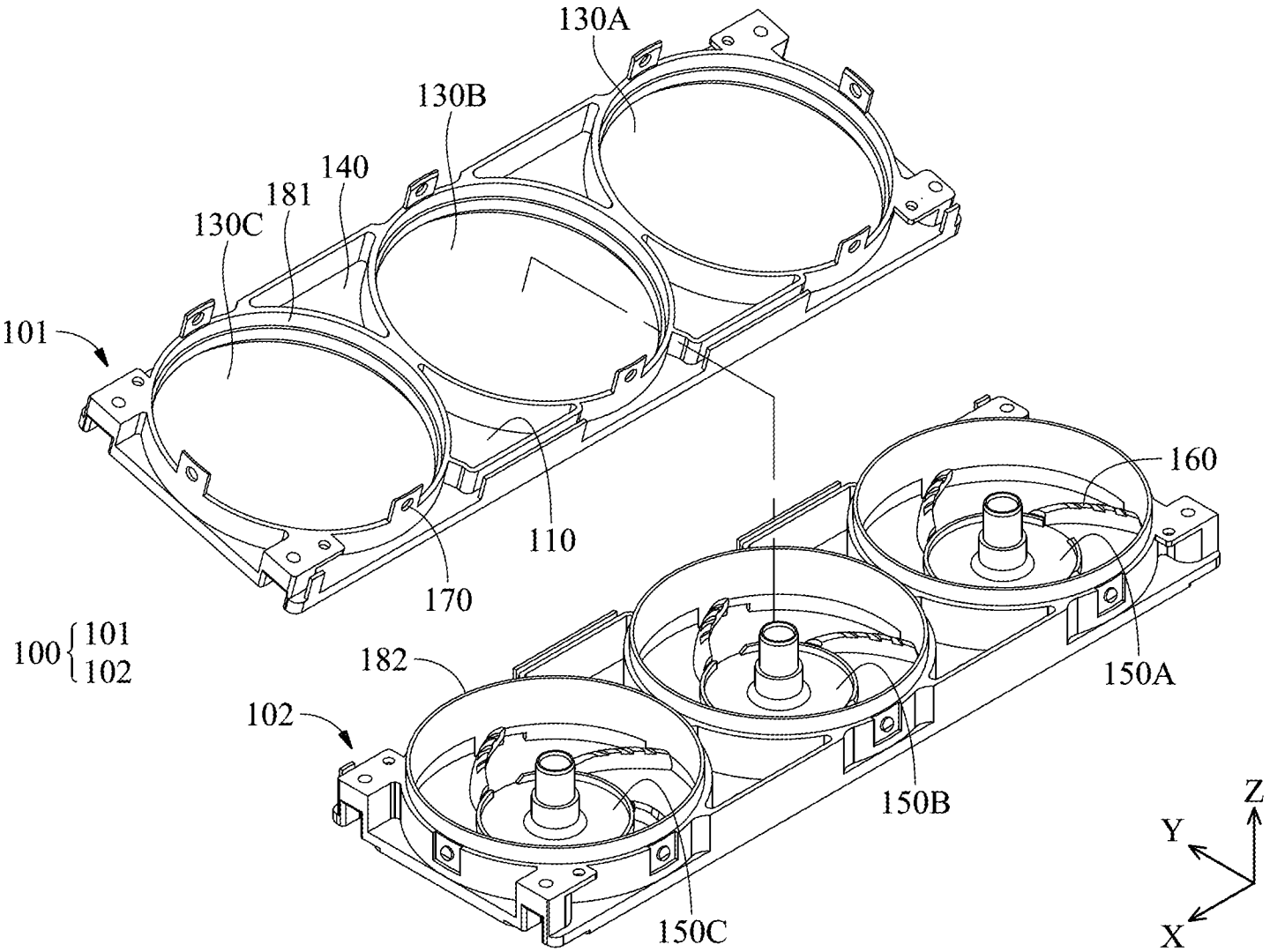
FIG. 5 is a schematic view illustrating the separated upper portion and the lower portion of the body shown in FIG. 2.

FIG. 5 is a schematic view illustrating the upper portion 101 and the lower portion 102, which are separated, of the body 100 shown in FIG. 2. As shown in FIG. 5, the upper portion 101 has a first positioning structure 181, and the lower portion 102 has a second positioning structure 182. The first positioning structure 181 and the second positioning structure 182 may be located on a sidewall 133 of the third channel 130C (and/or located on the sidewall 131 of the first channel 130A, the sidewall 132 of the second channel 130B). In the present embodiment, the first positioning structure 181 and the second positioning structure 182 may be stepped (also referred to as Z-shaped) structures corresponding to each other. In other words, after the first positioning structure 181 and the second positioning structure 182 are firmly combined, the first channel 130A, the second channel 130B, and/or the third channel 130C may have flat sidewalls 131, 132, and/or 133. That is, the first channel 130A, the second channel 130B, and/or the third channel 130C have flat inner surfaces, and the airflow would not be interfered. As the first positioning structure 181 and the second positioning structure 182 are firmly combined, it may be determined that the upper portion 101 and the lower portion 102 have been correctly positioned, and the upper portion 101 and the lower portion 102 may be combined via the connecting assembly 170. It should be noted that in the present embodiment, the first positioning structure 181 and the second positioning structure 182 merely serve as an example, the first positioning structure 181 and the second positioning structure 182 may be replaced with other suitable non-flat structure in order to achieve the positioning effect.

As set forth above, the present disclosure provides a fan frame including a hollow silencing structure. Thanks to the hollow spaces in the body of the fan frame, noise of a particular frequency generated during operation of the fan device may be effectively reduced. In addition, sizes of the spaces in the body and holes in cover plates may also be adjusted depending on the particular frequency of the noise. Furthermore, the body is divided into two pieces, so that the difficulty of molding may be reduced, and productivity may be increased. Corresponding positioning structures are disposed on an upper portion and a lower portion of the body, helping to precisely integrate the upper portion with the lower portion.

It should be noted that the terms "first," "second," and "third" used in foregoing paragraphs of the present specification are merely configured to indicate the same or similar element and/or structure disposed at different positions, but not intended to limit those element and/or structure. In other words, the first element and/or structure described in the claims is not necessarily limited to the first element and/or structure described in the specification, but should be identified as any element and/or structure that meets the definition.

While the embodiments and the advantages of the present disclosure have been described above, it should be understood that those skilled in the art may make various changes, substitutions, and alterations to the present disclosure without departing from the spirit and scope of the present disclosure. In addition, the scope of the present disclosure is not limited to the processes, machines, manufacture, composition, devices, methods and steps in the specific embodiments described in the specification. Those skilled in the art may understand existing or developing processes, machines, manufacture, compositions, devices, methods and steps from some embodiments of the present disclosure. As long as those may perform substantially the same function in the aforementioned embodiments and obtain substantially the same result, they may be used in accordance with some embodiments of the present disclosure. Therefore, the scope of the present disclosure includes the aforementioned processes, machines, manufacture, composition, devices, methods, and steps. Furthermore, each of the appended claims constructs an individual embodiment, and the scope of the present disclosure also includes every combination of the appended claims and embodiments.

What is claimed is:

1. A fan frame, comprising:

a body having a main surface and a first longitudinal side perpendicular to the main surface, wherein a first channel and a second channel adjacent to the first channel are formed in the body, and a first space is formed among the main surface, the first longitudinal side, a sidewall of the first channel, and a sidewall of the second channel, and the first space is entirely enclosed with the first longitudinal side, the sidewall of the first channel, and the sidewall of the second channel in a top view; and a first cover plate, disposed on the body, covering the first space, wherein a first hole is formed in the first cover plate, and the first space communicates with an external environment via the first hole.

2. The fan frame as claimed in claim 1, wherein the body further comprises an upper portion and a lower portion, the upper portion and the lower portion each has a connecting structure, and the upper portion and the lower portion are integrated by the connecting structures.

3. The fan frame as claimed in claim 2, wherein the upper portion and the lower portion each has a positioning structure located on the sidewall of the first channel and/or the sidewall of the second channel.

4. The fan frame as claimed in claim 1, further comprising:

a first base disposed in the first channel;

a second base disposed in the second channel; and a plurality of ribs disposed around the first base and the second base, wherein the first base and the second base are connected to the body via the ribs.

5. The fan frame as claimed in claim 4, wherein the ribs have a jagged structure disposed on one side of the ribs.

6. The fan frame as claimed in claim 1, wherein the first channel and the second channel penetrate the body.

7. The fan frame as claimed in claim 1, wherein the body further has a second side that is parallel to the first longitudinal side of the body, and a second space is formed among the main surface, the second side, the sidewall of the first channel, and the sidewall of the second channel.

8. The fan frame as claimed in claim 7, further comprising a second cover plate disposed on the body and covering the second space, wherein a second hole is formed on the second cover plate, and the second space communicates with the external environment via the second hole.

9. The fan frame as claimed in claim 7, wherein a volume of the second space is substantially equal to a volume of the first space.

* * * * *